US005603498A

United States Patent [19]

Crawford et al.

[11] Patent Number: 5,603,498

[45] Date of Patent: Feb. 18, 1997

[54] LIGHTWEIGHT FIELD HOCKEY STICK

[75] Inventors: William C. Crawford, Baltimore; Jackie L. Davis, Aberdeen, both of Md.

[73] Assignee: STX, Incorporated, Baltimore, Md.

[21] Appl. No.: 274,334

[22] Filed: Jul. 13, 1994

Related U.S. Application Data

[63] Continuation-in-part of Ser. No. 135,969, Oct. 14, 1993, abandoned.

[51] Int. Cl.[6] ..... A63B 59/12

[52] U.S. Cl. ..... 473/563; 473/562

[58] Field of Search ..... 273/67 A, 67 DA, 273/67 R

[56] References Cited

U.S. PATENT DOCUMENTS

| | | | |
|---|---|---|---|
| 3,720,410 | 3/1973 | Saytar | 273/67 A |
| 5,127,649 | 7/1992 | Carbonero | 273/67 A |

FOREIGN PATENT DOCUMENTS

| | | | |
|---|---|---|---|
| 3012300 | 10/1981 | Germany . | |
| 8808330 | 10/1988 | Germany . | |
| 9232 | of 1913 | United Kingdom | 273/67 DA |
| 1594674 | 8/1981 | United Kingdom . | |
| 8203789 | 11/1982 | WIPO | 273/67 A |

*Primary Examiner*—Mark S. Graham
*Attorney, Agent, or Firm*—Breiner & Breiner

[57] ABSTRACT

A multi-component, lightweight field hockey stick comprising a plastic head section and a handle fitted into the head section is described. The head section comprises a first flat surface including a flat ball-striking surface and a surface opposite the ball-striking surface so configured to decrease weight and provide increased structural strength. The surface area opposite the ball-striking surface includes an area for receiving a resilient pad. The field hockey stick is particularly useful as a learning or introductory stick for inexperienced players.

8 Claims, 2 Drawing Sheets

4
4
5
5
3
3
14
12
30
32
32
20
22
24
42
12b
12a
12a
12b
30
32
32
24
22
42

LIGHTWEIGHT FIELD HOCKEY STICK

RELATED APPLICATION

This application is a continuation-in-part of application Ser. No. 08/135,969 filed Oct. 14, 1993, abandoned.

FIELD OF THE INVENTION

This invention relates to a field hockey stick. More particularly, the invention relates to a lightweight field hockey stick which is easily constructed of relatively inexpensive components, making the stick particularly suitable as an introductory training stick or a stick for indoor play.

BACKGROUND OF THE INVENTION

Field hockey is an old and well-known sport with established rules and played in over one-hundred countries by women and men, and girls and boys. Although the game has certain established specifications for the field hockey stick used in play, the specifications are rather loosely defined. Moreover, in large part field hockey sticks are handmade primarily in countries where there is an abundance of hand laborers and where labor costs are low. As a result, it is often difficult to obtain sticks of uniform quality in a timely fashion. Further, the available sticks are all of a generally similar construction whether for a first-time, inexperienced player or for a veteran player.

Accordingly, there is substantial need for a field hockey stick design and method of construction whereby the field hockey sticks can be mass produced having essentially uniform qualities. There is a further need for a lightweight field hockey stick of substantially uniform quality with features similar to or the same as the features of a competitive field hockey stick which can be produced at relatively low cost and safe in the hands of first-time players as an introductory stick in order that the skills which an introductory player learns with the introductory stick can be immediately translated to the use of a competition stick.

OBJECTS AND SUMMARY OF THE INVENTION

It is a primary object of the present invention to provide a lightweight field hockey stick which is easily constructed of relatively inexpensive components to provide a stick having features similar to or the same as the features of a competitive field hockey stick in order that the skills which an introductory player learns with the introductory stick can be immediately translated to the use of a competition stick, making the stick particularly suitable as a training or introductory stick for indoor or outdoor use.

It is further object of the present invention to provide a field hockey stick having a design which permits variation in color and hardness characteristics of the stick components to provide for enhanced team play and for modification in the playing characteristics of the stick depending upon the playing area and playing conditions.

The objects of the present invention are obtained by constructing a field hockey stick of a plurality of separate components, a first component being a handle, preferably of aluminum or plastic; a molded lightweight plastic head section including a ball-striking area having high structural strength, and having an insert area at the surface opposite the ball-striking area for receiving a soft pad providing increased safety and improved appearance. This pad also serves as a visual and functional indicator to the beginning player, defining the permissible side of the stick to be used in striking the ball as defined by the rules of field hockey. The overall field hockey stick, therefore, is a multi-component stick fabricated to provide a unitary stick capable of varying characteristics particularly suitable as an introductory stick for first-time players. Further, the stick because of its lightweight design can be used in playing the game in confined areas with relative safety.

A primary feature of the introductory stick of the present invention is that the weight and length ratio of the stick are substantially the same weight and length ratio of a competition stick. In that way, the skills which an introductory player learns with the introductory stick can be immediately translated to the use of a competition stick. Thus, the overall length of the introductory stick of the present invention is from 31 to 36 inches and the overall weight is from 9.5 to 12 ounces. The handle has a weight of 3.5 to 5.3 ounces and a length of 17.5 to 23.5 inches measured from the end of the head section. The head has a weight of 3.5 to 7.0 ounces and a length of 13 to 17 inches. The receiving surface of the head section has a width of between 1.5 and 2.5 inches. These lengths and weights of the overall stick and the components of the introductory stick of this invention are substantially similar to or the same as the weight ratio of the overall stick and components of a competition stick.

In a preferred embodiment, the field hockey stick will comprise an aluminum handle inserted into a durable plastic head section preferably of high density polyethylene and having a flat surface similar to or the same as the flat surface of an official competitive stick including the ball-striking surface. There is a recessed area in the head section opposite the ball-striking surface for receiving a resilient pad which can be interchangeable. The handle, plastic head section, and the pad can be of varying colors so as to enhance team play whereby individual teams can have their own individual colors.

THE DRAWING AND DETAILED DESCRIPTION

Figures 1, 2, 3, 4, 5:
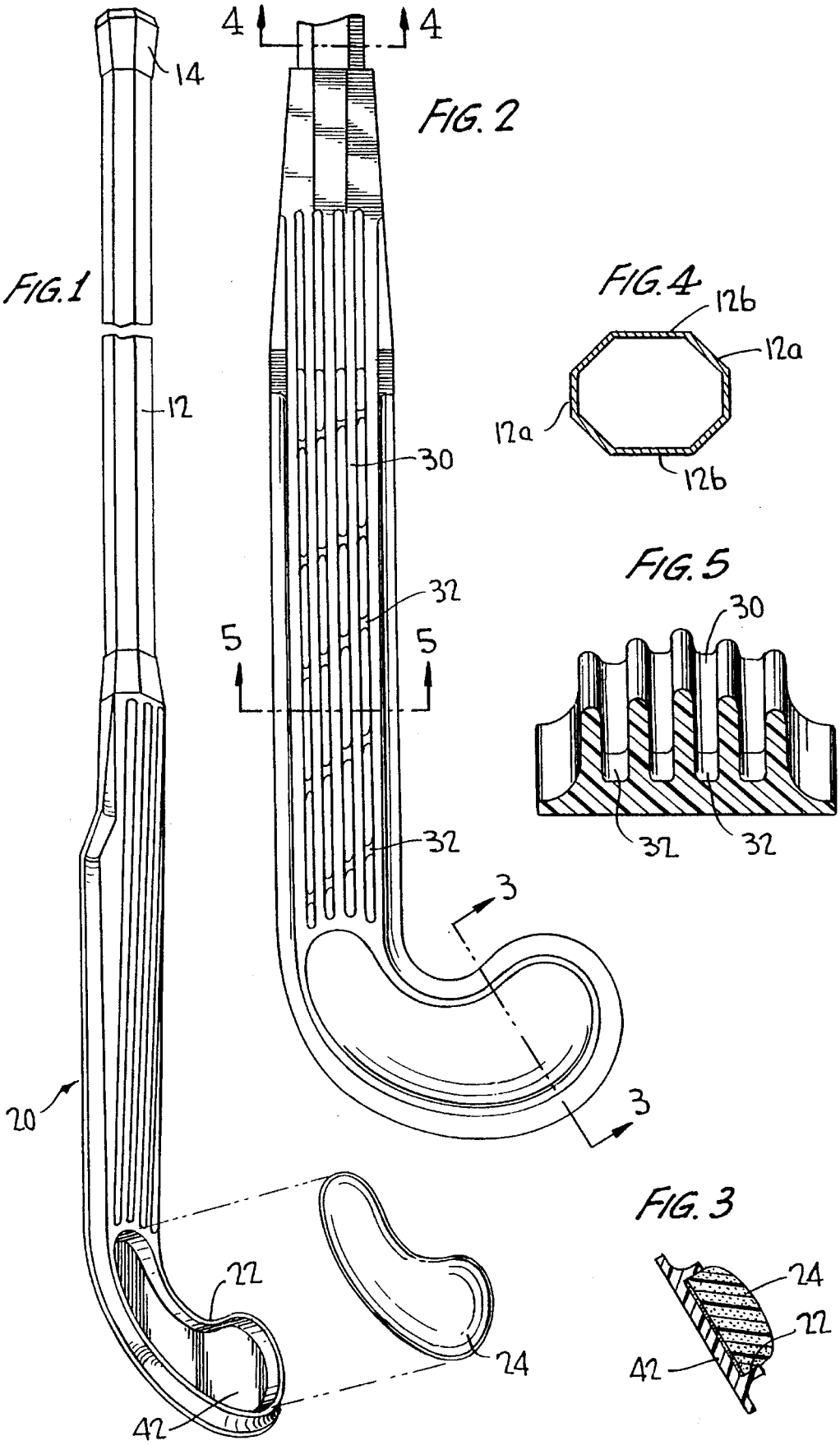
FIG. 1 is a perspective, partially exploded view of the field hockey stick of the present invention.
FIG. 2 is a rear elevational view of the lower end of the field hockey stick of FIG. 1.
FIG. 3 is a cross-sectional view of the ball striking surface along line 3—3 of FIG. 2.
FIG. 4 is a cross-sectional view of the handle along line 4—4 of FIG. 2.
FIG. 5 is a cross-sectional view of the head section along line 5—5 of FIG. 2.
Figure 7:
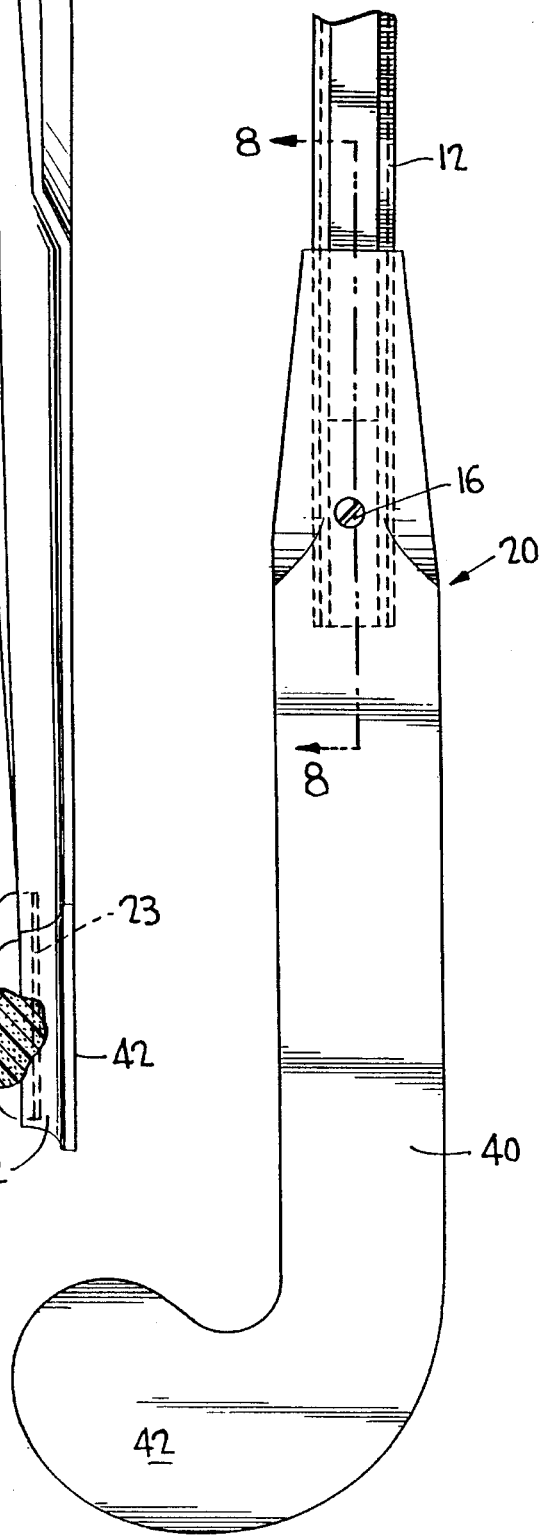
FIG. 7 is an elevational view of the hitting face of the lower end of the field hockey stick of FIG. 1.
Figure 8:
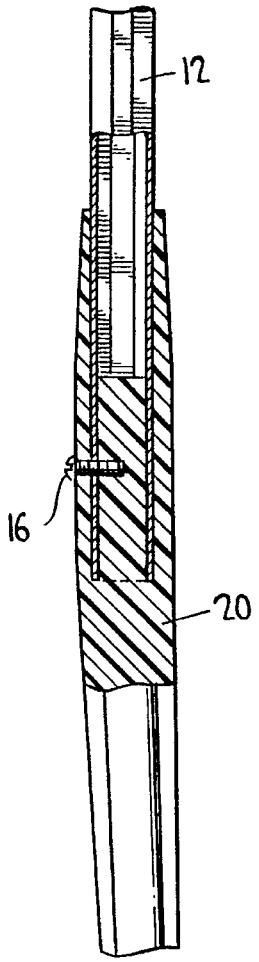
FIG. 8 is a view, partly in section, along line 8—8 of FIG. 7.

Referring first to FIGS. 1 and 2 of the drawing, it is seen that the field hockey stick comprises a handle 12 and a handle cap 14 fitting into a plastic head section 20. The head section comprises a flat surface 40 the same or similar to the flat surface of a competitive field hockey stick, as best seen in FIGS. 3 and 7, having a ball-striking area 42. The handle, preferably of aluminum but permissibly of a durable plastic such as high-density polyethylene, is inserted into the head section 20 as best shown in FIGS. 7 and 8. The handle can be fixedly secured to the head section by an indented screw 16. The handle, as best shown in FIG. 4, is preferably hollow and made elliptical in shape as a result of its octagonal configuration having sections 12*a* and 12*b* of different length.

The head section, as best shown in FIGS. 2, 5 and 7, comprises as previously stated a flat surface 40 and a rear surface 28 configured to decrease weight while retaining high structural strength. Thus, surface 28 as best shown in FIGS. 2 and 5, in a preferred embodiment, has a plurality of longitudinal slots or grooves 30 having horizontal ribs 32. Other suitable designs can include slots and ribs to provide a lightweight head section which still has high structural strength.

Figure 6:
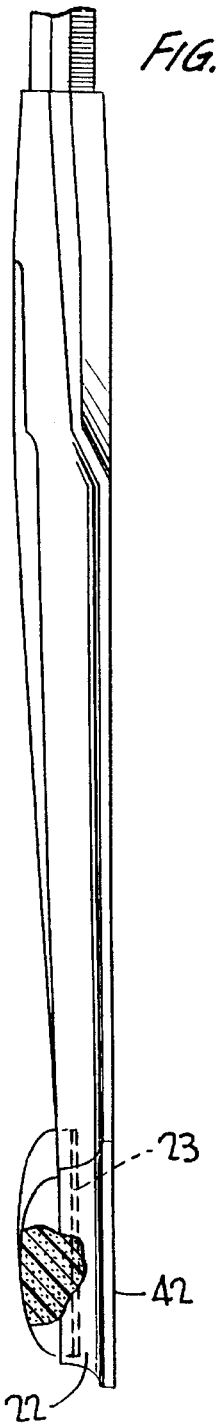
FIG. 6 is an elevational view of the front edge of the lower end, partly in section, of the field hockey stick of FIG. 1.

At the rear of ball-striking area 42 is a recessed area 22 for receiving mated pad 24, preferably of a soft foam such as a polyurethane foam, similar flexible foam, rubber, or an elastomer. Pad 24 can be of various colors and thicknesses, with different degrees of hardness. The foam section is replaceably fitted to the recess 22 by a suitable adhesive 23, shown in FIG. 6, or the like.

The present invention provides a unique field hockey stick which can be mass produced suitable for introductory play. As will be apparent to one skilled in the art, various modifications can be made within the scope of the aforesaid description. Such modifications being within the ability of one skilled in the art form a part of the present invention and are embraced by the appended claims.

It is claimed:

1. A multi-component field hockey stick comprising a plastic head section and an aluminum handle elliptical in shape fitted into grooves within said head section and fixedly secured thereto with indented screw means, said head section comprising a first flat surface including a ball-striking surface; ball receiving surface and a surface opposite said ball receiving surface so configured to decrease weight and provide increased structural strength and comprising a plurality of longitudinal grooves having horizontal ribs in said grooves for reducing weight and imparting increased structural strength, the surface area opposite said ball-striking surface having a recess for receiving a pad of a soft resilient material which is adhesively secured within said recess.

2. The field hockey stick of claim 1 wherein said resilient material is a foam.

3. The field hockey stick of claim 2 wherein said foam pad is a high-density polyethylene foam.

4. The field hockey stick of claim 2 wherein said foam pad is a polyurethane foam.

5. The field hockey stick of claim 1 wherein said plastic head section is a high-density polyethylene.

6. The field hockey stick of claim 1 wherein said plastic head section is a high-density polypropylene.

7. The field hockey stick of claim 1 wherein said handle is replacebly secured within said head section.

8. The field hockey stick of claim 1 wherein the length of the overall stick is between 31 and 36 inches and the weight of the overall stick is between 9.5 and 12 ounces.

* * * * *